United States Patent [19]

Komabashiri et al.

[11] Patent Number: 4,904,309

[45] Date of Patent: Feb. 27, 1990

[54] CHEMICAL CLEANING METHOD OF THE INTERIOR OF POLYMERIZATION REACTOR

[75] Inventors: Takamichi Komabashiri; Toragoro Mitani, both of Takasago; Hiroaki Yamauchi, Kakogawa; Hideo Yasui, Kobe, all of Japan

[73] Assignee: Kanegafuchi Chemical Industry Co., Ltd., Osaka, Japan

[21] Appl. No.: 263,956

[22] Filed: Oct. 26, 1988

Related U.S. Application Data

[63] Continuation of Ser. No. 57,878, Jun. 2, 1987, abandoned.

[30] Foreign Application Priority Data

Jun. 6, 1986 [JP] Japan ..... 61-132574

[51] Int. Cl.[4] ..... B08B 3/08

[52] U.S. Cl. ..... 134/42; 134/2; 134/7; 134/22.1; 134/22.16; 134/22.19; 264/39; 252/DIG. 8; 252/174; 525/74; 528/484

[58] Field of Search ..... 134/2, 7, 22.1, 22.16, 134/22.19, 38, 42; 264/39; 252/DIG. 8, 174; 525/74; 528/484

[56] References Cited

U.S. PATENT DOCUMENTS

| | | | |
|---|---|---|---|
| 3,005,734 | 10/1961 | Ells | 134/42 |
| 3,653,964 | 4/1972 | Yamamoto et al. | 134/42 |
| 3,740,267 | 6/1973 | Haylock | 134/42 |
| 3,865,628 | 2/1975 | Callahan et al. | 134/42 |
| 4,468,257 | 8/1984 | Kaneko et al. | 134/22.13 |

FOREIGN PATENT DOCUMENTS

| | | | |
|---|---|---|---|
| 7342222 | 9/1970 | Japan | 134/22.17 |
| 539065 | 9/1974 | U.S.S.R. | 134/22.17 |

*Primary Examiner*—Asok Pal

*Attorney, Agent, or Firm*—Jordan and Hamburg

[57] ABSTRACT

A chemical cleaning method for removing scales and other substances deposited on the interior of a polymerization reactor used in emulsion polymerization or suspension polymerization. This method comprises chemically cleaning the interior using an aqueous solution or dispersion of an alkali agent and a surfactant. According to this method of cleaning, scales deposited on the interior of a polymerization reactor, in particular, scales deposited during polymerization on the inside surface, an agitator and baffle-plates of the reactor are completely removed.

13 Claims, No Drawings

CHEMICAL CLEANING METHOD OF THE INTERIOR OF POLYMERIZATION REACTOR

This application is a continuation, of application Ser. No. 057,878, filed June 2, 1987, now abandoned.

BACKGROUND OF THE INVENTION

This invention relates to a chemical cleaning method for removing the scales or other materials deposited on the interior of a polymerization reactor which has been used in emulsion polymerization or suspension polymerization.

The conventional plant cleaning technique includes mechanical cleaning and chemical cleaning. The mechanical cleaning includes a high-pressure jet cleaning, blast cleaning, and pig cleaning. The chemical cleaning includes alkali cleaning, acid cleaning, and emulsion cleaning. The alkali cleaning is generally used for removing oils and fats by use of caustic soda, sodium carbonate, etc. The acid cleaning is usually used for cleaning and removing inorganic scales, etc., with hydrochloric acid, sulfuric acid, nitric acid, phosphoric acid, etc.. The emulsion cleaning is suitable for cleaning and removing oils and fats with a surfactant, etc.

Among these methods, generally, the mechanical cleaning, in particular the high-pressure jet, is employed to remove scales deposited on the interior of a polymerization reactor such as the inside surface, an agitator, and baffle-plates. It is usually difficult, however, for the high-pressure jet cleaning to completely remove the scales. To completely clean the inside surface of the reactor in advance, it is necessary to apply scale deposition preventing agent having function of a chelate compound on the inside surface of an polymerization reactor. Thus the high-pressure jet cleaning cannot be used for such a purpose.

BRIEF SUMMARY OF THE INVENTION

It is an object of the invention to provide a method for completely removing scales deposited on the interior of a polymerization reactor, particularly, those scales deposited during polymerization on various parts such as the inside surface of the reactor, an agitator, and baffle-plates.

This object is attained by cleaning through agitating an aqueous solution or an aqueous dispersion under heating in the reactor to be cleaned, which aqueous solution or dispersion comprising an alkali agent of one or two or more types of sodium compounds or potassium compounds and one or two or more types of surfactants.

This invention provides for a chemical method of cleaning the interior of a polymerization reactor such as inside walls, an agitator, and baffle-plates of a polymerization reactor which has been used in emulsion polymerization or suspension polymerization of polymerizable monomers alone or as a mixture in the presence of a initiator, the method comprising the use of an alkali agent of one or two or more types of sodium compounds and potassium compounds and one or two or more types of surfactants in chemical cleaning.

DETAILED DESCRIPTION OF PREFERRED EMBODIMENTS

The apparatus intended for cleaning by the method of the present invention is a polymerization reactor which has been used in emulsion polymerization or suspension polymerization. Preferable is the cleaning of apparatus used for emulsion polymerization of acrylic ester monomer or methacrylic ester monomer or a mixture thereof, or for emulsion polymerization of butadiene or styrene and/or substituted styrene. The substituted styrene includes α-methylstyrene, vinyltoluene, ortho-chlorostyrene and the like. Other preferable apparatus include a polymerization reactor for manufacturing polyvinyl chloride resin by suspension polymerization, those for manufacturing paste resin of polyvinyl chloride, those for manufacturing polystyrene beads by suspension polymerization, and those for manufacturing copolymer of acrylonitrile and vinyl chloride by emulsion polymerization.

The alkali agent used in the invention includes an alkali builder available as a soap builder. Examples of the alkali agent are sodium metasilicate, sodium orthosilicate, sodium silicate, sodium orthophosphate, sodium pyrophosphate, sodium tripolyphosphate, sodium hexametaphosphate, potassium metasilicate, caustic soda, sodium carbonate, sodium bicarbonate, caustic potash, potassium carbonate, and potassium bicarbonate.

The surfactant is preferably excellent in wet permeability, emulsifiability, and dispersibility and has a strong detergency. More preferably, it has an excellent biodegradability. Examples of surfactants satisfying such requirements are (1) anionic surfactants such as fatty acid salts like semihardened potassium soap of beef tallow fatty acid, semihardened sodium soap of beef tallow fatty acid, potassium soap of oleic acid, potassium soap of castor oil, sodium soap of stearic acid, solid bar or solid flake sodium soap of mixed fatty acid; a salt of naphthalenesulfonic acid-formaldehyde condensate such as sodium salt of β-naphthalenesulfonic acid-formaldehyde condensate; alkylnaphthalenesulfonate such as sodium alkylnaphthalenesulfonate; alkylsulfosuccinate such as sodium dialkylsulfosuccinate; and alkyldiphenyl ether disulfonate such as sodium alkyldiphenyl ether disulfonate: (2) nonionic surfactant such as polyoxyethylene alkyl ether like polyoxyethylene nonylphenyl ether and polyoxyethylene octylphenyl ether; and polyoxyethylene derivatives: and (3) ampholytic surfactant such as lauryl betaine and lauryldimethylamine oxide.

Among these, particularly preferable are anionic surfactant and nonionic surfactant.

These alkali agents comprising one or two or more types of sodium compounds and potassium compounds, and one or more types of surfactants are suitably selected and used.

The mechanism of cleaning, i.e. removing stains from metal surface has been explained by the combination of the two effects as follows:

(1) Separating the stain from the metal surface and attracting it into the cleaning solution, and (2) Preventing redeposition of the stains by keeping them stable in the cleaning solution.

The effect (1) is explained to mean that the detergent decreases the interfacial free energy between the stains and the metal, and liberates the stains from the metal into the cleaning solution by the mechanical action or the interfacial potential between the stains and the metal. The effect (2) is explained to mean that the hydration layer or electric charge given by the detergent adsorbed to the metal or stains prevents the redeposition of the stains. In the scale removal from the metal surface as well, it is explained that alkali agents and surfactants effect chemical cleaning by the said phenomena (1) and (2).

The cleaning effect is heightened by the use of a combination of alkali agent and another alkali agent or a combination of one or more types of alkali agents and one or more types of surfactants. Preferable combinations include sodium metasilicate and caustic soda, sodium metasilicate and caustic potash, sodium metasilicate and sodium carbonate, sodium metasilicate and sodium bicarbonate, sodium orthosilicate and caustic soda, sodium orthosilicate and caustic potash, sodium orthosilicate and sodium carbonate, sodium orthosilicate and sodium bicarbonate, sodium tripolyphosphate and caustic soda, sodium tripolyphosphate and caustic potash, sodium tripolyphosphate and sodium carbonate, sodium tripolyphosphate and sodium bicarbonate, sodium hexametaphosphate and caustic soda, sodium hexametaphosphate and caustic potash, sodium hexametaphosphate and sodium carbonate, sodium hexametaphosphate and sodium bicarbonate, and a combination of each of these combinations with a surfactant. Examples of a surfactant which can be used particularly favorably in combination with each of the above combinations of alkali agents and other alkali agents are semihardened potassium soap of beef tallow fatty acid (e.g. KS soap from Kao Soap Co.), semihardened sodium soap of beef tallow fatty acid soap (e.g. NS soap from Kao Soap Co.), sodium salt of $\beta$-naphthalenesulfonic acid-formaldehyde condensate (e.g. Demol N from Kao Soap Co.), polyoxyethylene nonylphenyl ether (e.g. Kao Soap Co. EMULGEN 909, EMULGEN 910, EMULGEN PI-20T, EMULGEN 911, EMULGEN 913, EMULGEN 920, EMULGEN 930, EMULGEN 931, EMULGEN 935, EMULGEN 950, EMULGEN 985, EMULGEN 903, EMULGEN 904, EMULGEN 905, EMULGEN 906), sodium alkyldiphenyl ether disulfonate (e.g. Pelex SS-H and Pelex SS-L from Kao Soap Co.).

The concentration in use of the alkali agent and that of the surfactant depend upon the type thereof. However the former is 0.01–50 W/V %, preferably 0.1–30 W/V %, more preferably 0.5–10 W/V %, and the latter is 0.01–10 W/V %, preferably 0.1–5 W/V %, more preferably 0.3–2 W/V %. If the concentrations used of the alkali agent and the surfactant are too low, cleaning effects become insufficient. Even with concentrations of the alkali agent and the surfactant excessively raised, increase of the cleaning effects cannot be expected.

The concentrations in use of chemicals of each combination are specifically exemplified as follows:

(1) Sodium metasilicate, caustic soda, and semihardened potassium soap of beef tallow fatty acid: 0.1–40 W/V %, 0.1–10 W/V %, and 0.05–5 W/V %; preferably, 0.2–10 W/V %, 0.2–5 W/V %, and 0.1–2 W/V %; and more preferably, 0.5–10 W/V %, 0.5–2 W/V %, and 0.3–1 W/V %, (2) sodium metasilicate, caustic potash, semihardened potassium soap of beef tallow fatty acid: 0.1–40 W/V %, 0.1–5 W/V %, and 0.05–5 W/V %; preferably 0.2–10 W/V %, 0.2–2 W/V %, and 0.1–2 W/V %; and more preferably 0.5–10 W/V %, 0.5–1 W/V %, and 0.3–1 W/V %, (3) sodium metasilicate, sodium carbonate, and semihardened potassium soap of beef tallow fatty acid: 0.1–40 W/V %, 0.2–15 W/V %, and 0.05–5 W/V %; preferably 0.2–30 W/V %, 0.3–10 W/V %, and 0.1–3 W/V %; and more preferably 0.5–10 W/V %, 0.5–5 W/V %, and 0.3–2, (4) sodium metasilicate, sodium bicarbonate, and semihardened potassium soap of beef tallow fatty acid: 0.1–40 W/V %, 0.2–15 W/V %, and 0.05–5 W/V %; preferably 0.2–30 W/V %, 0.5–10 W/V %, and 0.1–3 W/V %; and more preferably 0.5–10 W/V %, 1–5 W/V %, and 0.3–2 W/V %, (5) sodium orthosilicate, caustic soda, and semihardened potassium soap of beef tallow fatty acid: 0.1–40 W/V %, 0.1–5 W/V %, and 0.05–5 W/V %; preferably 0.2–30 W/V %, 0.2–3 W/V %, and 0.1–3 W/V %; and more preferably 0.5–10 W/V %, 0.5–2 W/V %, and 0.3–2 W/V %, (6) sodium orthosilicate, caustic potash, and semihardened potassium soap of beef tallow fatty acid: 0.1–40 W/V %, 0.1–5 W/V %, and 0.05–5 W/V %; preferably 0.2–30 W/V %, 0.2–2 W/V %, and 0.1–3 W/V %; and more preferably 0.5–10 W/V %, 0.5–1 W/V %, and 0.3–2 W/V %, (7) sodium orthosilicate, sodium carbonate, and semihardened potassium soap of beef tallow fatty acid: 0.1–40 W/V %, 0.2–15 W/V %, and 0.05–5 W/V %; preferably 0.2–30 W/V %, 0.3–10 W/V %, and 0.1–3 W/V %; and more preferably 0.5–10 W/V %, 0.5–5 W/V %, and 0.3–2 W/V, (8) sodium orthosilicate, sodium bicarbonate, and semihardened potassium soap of beef tallow fatty acid: 0.1–40 W/V %, 0.2–15 W/V %, and 0.05–5 W/V %; preferably 0.2–30 W/V %, 0.5–10 W/V %, and 0.1–3 W/V %; and more preferably 0.5–10 W/V %, 1–5 W/V %, and 0.3–2 W/V %.

The alkali agent and the surfactant are completely dissolved in water. In a very rare case, however, some may remain not dissolved. In such a case they have to be agitated until they are uniformly dispersed.

Materials of a polymerization reactor, an agitator, and baffle-plates may be metals such as stainless steels (SUS 304, 316, 316L, etc.) or glass. For glass, however, special considerations may be necessary since the resistance of some kinds of glass to alkali are insufficient.

To feed the cleaning chemical into the reactor, the alkali agent and the surfactant in powder, flake, liquid or other form may be put in after water has been fed or vice versa. Also, the aqueous detergent solution may be prepared in a vessel other than the polymerization reactor and fed into the reactor with a pump or the like.

The aqueous detergent solution or dispersion is held at a temperature of 100° C. or less, preferably at 40°–90° C. by means of a jacket and/or a heating coil of a polymerization reactor, and is agitated by an agitator and the like to effect chemical cleaning. The time required for cleaning is usually within two days, but often a 6-hour cleaning may be sufficient.

According to the cleaning method of the present invention, scales deposited on the interior of a polymerization reactor, particularly, those scales deposited on the inside wall surface, an agitator, and baffle-plates of the reactor during polymerization can be completely removed.

It is preferable to apply on the inside surface of the reactor, an agitator, and baffle-plates, for example, scale deposition preventing agent having function of a chelate compound, but it is not mandatory. A polymerization reactor with scale deposition preventing agent applied thereon is more remarkably effected by the chemical cleaning than a reactor without scale deposition preventing agent applied.

Examples of the embodiments of this invention are hereinbelow described with respect to emulsion polymerization systems and suspension polymerization systems. Polymerization systems which contain acrylic ester monomer, methacrylic ester monomer, or a mixture thereof are particularly suitable for the method of this invention and are described in detail. However, the invention is not limited by such examples.

EXAMPLE 1

The surface of a test piece 20 mm wide and 100 mm long made of stainless steel (SUS 304) #400 buff finished was further subjected to electro-polishing. Into a lidded 1-l glass reactor, 560 ml of styrene-butadiene copolymer latex (solid content 30%), 320 ml of deionized water, 0.012 g of disodium ethylenediaminetetraacetate, 0.003 g of ferrous sulfate, and 0.2 g of rongalite were put. The inside temperature was adjusted to 60° C., and after adding 60 ml of potassium sulfate solution (6.5% aqueous solution), 75 ml of methyl methacrylate containing 0.15 g of cumene hydroperoxide was added in 25-ml portions every 30 min and polymerized for 3 hours. Then, 0.3 g of cumene hydroperoxide was added and polymerization was conducted for one hour. Then, the test piece was immersed in the latex to deposit scales on the surface thereof. The test piece with scales deposited thereon was dried at 80° C. for one hour, and the polymerization operation was repeated once more. After drying at 80° C. for one hour again, the test piece was dried at 100° C. a further one hour.

A scale removing test was effected in such a manner that the thus obtained test piece with scales deposited thereon was immersed in a 4-l stainless steel bath containing the alkali agent and the aqueous surfactant solution. The test conditions and results are shown in Table 1.

TABLE I

| Item | Experiment No. 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|
| Alkali agent | | | | | | | | | | | | | | | | | | | | | | | |
| Sodium metasilicate (w/v %) | 2.0 | | | | | | | 2.0 | 2.0 | 2.0 | 4.0 | 4.0 | 4.0 | 4.0 | 4.0 | 4.0 | 4.0 | 4.0 | 4.0 | 4.0 | 4.0 | 4.0 | 4.0 |
| Sodium orthosilicate (w/v %) | | 2.0 | | | | | | | | | | | | | | | | | | | | | |
| Sodium silicate (w/v %) | | | 2.0 | | | | | | | | | | | | | | | | | | | | |
| Sodium orthophosphate (w/v %) | | | | 2.0 | | | | | | | | | | | | | | | | | | | |
| Sodium pyrophosphate (w/v %) | | | | | 2.0 | | | | | | | | | | | | | | | | | | |
| Sodium tripolyphosphate (w/v %) | | | | | | 2.0 | | | | | | | | | | | | | | | | | |
| Sodium hexametaphosphate (w/v %) | | | | | | | 2.0 | | | | | | | | | | | | | | | | |
| Caustic soda (w/v %) | 1.0 | 1.0 | 1.0 | 1.0 | 1.0 | 1.0 | 1.0 | | | 1.0 | 1.0 | 1.5 | 1.5 | 1.5 | 1.5 | 1.5 | 1.5 | 1.5 | 1.5 | 1.5 | 1.5 | 1.5 | 1.5 |
| Sodium carbonate (w/v %) | | | | | | | | 1.0 | | | | | | | | | | | | | | | |
| Sodium bicarbonate (w/v %) | | | | | | | | | 1.0 | | | | | | | | | | | | | | |
| Surfactant | | | | | | | | | | | | | | | | | | | | | | | |
| Anionic | | | | | | | | | | | | | | | | | | | | | | | |
| Semihardened potassium soap of beef tallow fatty acid (w/v %) | 0.5 | 0.5 | 0.5 | 0.5 | 0.5 | 0.5 | 0.5 | 0.5 | 0.5 | | 0.5 | 0.5 | | | | | | | | | | | |
| Sodium salt of β-naphthalenesulfonic acid-formaldehyde condensate (w/v %) | | | | | | | | | | 0.5 | | | | | | | | | | | | | |
| Sodium alkylnaphthalenesulfonate (w/v %) | | | | | | | | | | | | | 0.5 | | | | | | | | | | |
| Sodium dialkylsulfosuccinate (w/v %) | | | | | | | | | | | | | | 0.5 | | | | | | | | | |
| Sodium alkyldiphenyl ether disulfonate (w/v %) | | | | | | | | | | | | | | 0.5 | 0.4 | | | | | | | | |
| Nonionic | | | | | | | | | | | | | | | | | | | | | | | |
| Polyoxyethylene nonylphenyl ether A (Note 1) (w/v %) | | | | | | | | | | | | | | | | 0.1 | 0.5 | | | | | | |
| Polyoxyethylene nonylphenyl ether B (Note 2) (w/v %) | | | | | | | | | | | | | | | | | | 0.5 | | | | | |
| Polyoxyethylene nonylphenyl ether C (Note 3) (w/v %) | | | | | | | | | | | | | | | | | | | 0.5 | | | | |
| Polyoxyethylene nonylphenyl ether D (Note 4) (w/v %) | | | | | | | | | | | | | | | | | | | | 0.5 | | | |
| Polyoxyethylene derivative (w/v %) | | | | | | | | | | | | | | | | | | | | | 0.5 | | |
| Ampholytic | | | | | | | | | | | | | | | | | | | | | | | |
| Lauryl betaine (w/v %) | | | | | | | | | | | | | | | | | | | | | | 0.5 | |
| Lauryldimethylamine oxide (w/v %) | | | | | | | | | | | | | | | | | | | | | | | 0.5 |
| Treating temperature (°C.) | 85 | 85 | 85 | 85 | 85 | 85 | 85 | 85 | 85 | 85 | 85 | 85 | 85 | 85 | 85 | 85 | 85 | 85 | 85 | 85 | 85 | 85 | 85 |
| Time required for natural peeling off of scales (Hr.) | 2.0 | 5.0 | 6.0 | 5.0 | 5.5 | 4.0 | 5.0 | 6.0 | 5.5 | 4.0 | 1.0 | 0.5 | 1.5 | 2.5 | 2.5 | 2.5 | 1.0 | 1.0 | 0.5 | 0.5 | 2.0 | 2.5 | 3.0 |

(Note 1) EMULGEN 909 made by Kao Soap Co.
(Note 2) EMULGEN 910 made by Kao Soap Co.
(Note 3) EMULGEN PI-20T made by Kao Soap Co.
(Note 4) EMULGEN 911 made by Kao Soap Co.

EXAMPLE 2

After a quinone-amine compound scale deposition preventing agent was applied to the inside surface, agitator, and baffle-plates of a 3-l stainless steel polymerization reactor provided with an agitator and was dried, in the reactor, methyl methacrylate was graft polymerized onto to styrene-butadiene copolymer latex in the same manner as in Example 1. After a repetition of the polymerization 12 times, a thin deposit of polymer scales was found on the inside wall of the reactor when the polymer was taken out. After washing the scales with water, chemical cleaning was conducted employing the following cleaning chemicals:

| Cleaning chemicals | Concentration (W/V %) |
|---|---|
| Sodium metasilicate ($Na_2SiO_3.9H_2O$) | 2.0 |
| Caustic soda (NaOH) | 1.0 |
| Semihardened potassium soap of beef tallow fatty acid (anionic surfactant) | 0.5 |

The cleaning chemicals were kept at 85° C. and agitated for 6 hours. As a result, about a half of the scales deposited on the inside wall of the reactor were naturally removed and the remaining about a half was also readily removed by tap water applied from a hose.

EXAMPLE 3

In a 100-l stainless steel polymerization reactor provided with an agitator, styrene-butadiene copolymer latex was prepared by emulsion polymerization of styrene and butadiene. Onto the latex, methyl methacrylate was further graft polymerized by use of the same manner as in Example 1. When the polymer latex was taken out after polymerization was completed, polymer scales were found deposited on the inside wall of the reactor. After washing the inside wall of the reactor with water, chemical cleaning was applied to the inside wall of the reactor with the chemicals of the following composition:

| Cleaning chemicals | Concentration (W/V %) |
|---|---|
| Sodium metasilicate ($Na_2SiO_3.9H_2O$) | 4.0 |
| Caustic soda (NaOH) | 1.0 |
| Semihardened potassium soap of beef tallow fatty acid (anionic surfactant) | 0.5 |

The cleaning chemicals were kept at 85° C. and agitated for 6 hours. As a result, a part of the scales deposited on the inside wall of the reactor was naturally removed, and remaining scales were also readily removed by tap water applied from a hose.

EXAMPLE 4

Into a 3-l stainless steel polymerization reactor with agittor, 1.5 l of deionized water and 1.5 kg of styrene monomer were fed, and by use of 0.3 parts (PHR) of benzoyl peroxide as an initiator and 0.1 part (PHR) of polyvinyl alcohol as a dispersant, the styrene was suspension polymerized by agitating at 85° C. for 8 hours. When the polymer suspension was taken out after polymerization had been completed, polymer scales were found deposited around the gas-liquid interface.

Chemical cleaning was applied with the cleaning chemicals in the following table:

| Cleaning chemicals | Concentration (W/V %) |
|---|---|
| Sodium metasilicate ($Na_2SiO_3.9H_2O$) | 2.0 |
| Caustic soda (NaOH) | 1.0 |
| Semihardened potassium soap of beef tallow fatty acid (anionic surfactant) | 0.5 |

The cleaning chemicals were kept at 85° C. and agitated for 6 hours. As a result, the scales deposited on the inside wall of the reactor were readily removed by tap water jetted thereon from a hose.

EXAMPLE 5

Into a 3-l polymerization reactor made of stainless steel provided with a agitator, 1.0 l of deionized water and 1.0 kg of vinyl chloride monomer were fed, and by use of sodium lauryl sulfate and in the presence of a redox catalyst comprising hydrogen peroxide and sodium sulfite, the vinyl chloride was emulsion polymerized. When the polymer latex was taken out after polymerization has been completed, polymer scales were found deposited on the inside wall of the reactor.

Chemical cleaning was effected with the following cleaning chemicals:

| Cleaning chemicals | Concentration (W/V %) |
|---|---|
| Sodium metasilicate ($Na_2SiO_3.9H_2O$) | 2.0 |
| Caustic soda (NaOH) | 1.0 |
| Semihardened potassium soap of beef tallow fatty acid (anionic surfactant) | 0.5 |

The cleaning chemicals were kept at 85° C. and agitated for 6 hours. As a result, the scales deposited on the inside wall of the reactor was readily removed by tap water jetted thereon from a hose.

EXAMPLE 6

Into a 3-l polymerization reactor made of stainless steel and provided with an agitator, 1.5 l of deionized water, 500 g of acrylonitrile, and 500 g of vinyl chloride were fed, and by use of 0.3 parts (PHR) of potassium peroxydisulfate as an initiator and in the presence of 0.05 parts (PHR) of sodium alkylbenzenesulfonate as a surfactant, an emulsion polymerization was effected. When the copolymer latex was taken out after the polymerization had been completed, polymer scales were found deposited on the inside walls of the reactor.

Chemical cleaning was effected with the cleaning chemicals shown in the following table.

| Cleaning chemicals | Concentration (W/V %) |
|---|---|
| Sodium metasilicate ($Na_2SiO_3.9H_2O$) | 2.0 |
| Caustic soda (NaOH) | 1.0 |
| Semihardened potassium soap of beef tallow fatty acid (anionic surfactant) | 0.5 |

The cleaning chemicals were kept at 65° C. and agitated for 6 hours. As a result, the scales deposited on the inside wall of the reactor were readily removed by tap water jetted thereon from a hose.

EXAMPLE 7

Into a 3-l stainless steel polymerization reactor provided with an agitator, 1.5 l of deionized water and 1.0 kg of vinyl chloride monomer were fed, and by use of 0.04 parts (PHR) of polyvinyl alcohol as a dispersant and 0.3 parts (PHR) of lauroyl peroxide as an initiator, vinyl chloride was suspension polymerized. When the polymer suspension was taken out after the polymerization had been completed, polymer scales were found deposited on the inside wall of the reactor.

Chemical cleaning was affected by use of the cleaning chemicals shown in the following table:

| Cleaning chemicals | Concentration (W/V %) |
|---|---|
| Sodium metasilicate ($Na_2SiO_3.9H_2O$) | 2.0 |
| Caustic soda (NaOH) | 1.0 |
| Semihardened potassium soap of beef tallow fatty acid (anionic surfactant) | 0.5 |

The cleaning chemicals were kept at 85° C. and agitated for 6 hours. As a result, the scales deposited on the inside wall of the reactor were readily removed by tap water applied from a hose.

What is claimed is:

1. A method of chemical cleaning the interior surfaces such as the inside wall, an agitator, and baffle-plates of a polymerization reactor which has been used for emulsion polymerization or suspension polymerization of polymerizable monomers comprising butadiene in the presence of an initiator, wherein said method comprises chemical cleaning said surfaces by contacting them with an aqueous solution or suspension at a temperature from 40° C. to 100° C. and comprising at least one alkali selected from the group consisting of sodium and potassium silicate and phosphate salts, further comprising at least one alkali other than a silicate or phosphate, and at least one surfactant.

2. A method of claim 1, wherein said silicate and phosphate salts are selected from the group consisting of sodium metasilicate, potassium metasilicate, sodium orthosilicate, potassium orthosilicate, sodium tripolyphosphate, sodium hexametaphosphate, sodium orthophosphate and sodium pyrophosphate, and said other alkali is selected from the group consisting of caustic soda, caustic potash, sodium carbonate, potassium carbonate, sodium bicarbonate, and potassium bicarbonate.

3. A method of claim 1, wherein said surfactant is anionic or nonionic.

4. A method of claim 1, wherein the concentration of said silicate or phosphate is 0.01–50 W/V %.

5. A method of claim 1, wherein said concentration of the silicate or phosphate is 0.1–30 W/V %.

6. A method of claim 1, wherein said concentration of the silicate or phosphate is 0.5–10 W/V %.

7. A method of claim 1, wherein the concentration of said other alkali is 0.01–50 W/V %.

8. A method of claim 1, wherein said concentration of the other alkali is 0.1–30 W/V %.

9. A method of claim 1, wherein said concentration of the other alkali is 0.5–10 W/V %.

10. A method of claim 1, wherein said concentration of the surfactant is 0.01–10 W/V %.

11. A method of claim 1, wherein said concentration of the surfactant is 0.1–5 W/V %.

12. A method of claim 1, wherein said concentration of the surfactant is 0.3–2 W/V %.

13. A method of claim 1, wherein said salts are selected from the group consisting of sodium metasilicate and potassium metasilicate and said other alkali is selected from the group consisting of caustic soda and caustic potash.

* * * * *